US011308826B2

(12) United States Patent
Frost

(10) Patent No.: US 11,308,826 B2
(45) **Date of Patent: *Apr. 19, 2022**

(54) MODULAR SIGN

(71) Applicant: VANGUARD PACKAGING, LLC, Kansas City, MO (US)

(72) Inventor: Jerry Ryan Frost, Kansas City, MO (US)

(73) Assignee: Vanguard Packaging, LLC, Kansas City, MO (US)

( * ) Notice: Subject to any disclaimer, the term of this patent is extended or adjusted under 35 U.S.C. 154(b) by 64 days.

This patent is subject to a terminal disclaimer.

(21) Appl. No.: 16/877,114

(22) Filed: May 18, 2020

(65) Prior Publication Data

US 2020/0279513 A1 Sep. 3, 2020

Related U.S. Application Data

(63) Continuation-in-part of application No. 14/960,747, filed on Dec. 7, 2015, now Pat. No. 10,654,611, and a continuation-in-part of application No. 15/194,227, filed on Jun. 27, 2016, now Pat. No. 10,896,629.

(60) Provisional application No. 62/088,163, filed on Dec. 5, 2014, provisional application No. 62/184,731, filed on Jun. 25, 2015.

(51) Int. Cl.
*G09F 7/18* (2006.01)

(52) U.S. Cl.
CPC ..... *G09F 7/18* (2013.01); *G09F 2007/1817* (2013.01)

(58) Field of Classification Search
CPC ..... G09F 7/18; G09F 2007/1817; G09F 1/065
See application file for complete search history.

(56) References Cited

U.S. PATENT DOCUMENTS 2,939,236 A * 6/1960 Stein ..... G09F 1/14 40/311
3,709,371 A 1/1973 Luck
(Continued)

OTHER PUBLICATIONS

"Advisory Action Received for U.S. Appl. No. 15/194,227, dated Apr. 6, 2020, 03 Pages", 3.
(Continued)

*Primary Examiner* — David R Dunn
*Assistant Examiner* — Christopher E Veraa
(74) *Attorney, Agent, or Firm* — Kutak Rock LLP

(57) ABSTRACT

A modular sign including a spacer assembly affixed to graphic panels is provided. The modular sign is movable between a knock-down configuration and an erected configuration. In the knock-down configuration, the spacer assembly lays flat on a back surface of the graphic panels. In the erected configuration, the spacer assembly is positioned behind the graphic panels so as to provide a support structure for the graphic panels while simultaneously being at least partially concealed by the graphic panels. The modular sign is moved from the knock-down configuration to the erected configuration by rotating the graphic panels up and away from a flat surface and is secured in the erected configuration by inserting a key flap into a keyhole. Once the modular sign is in the erected configuration, it can be installed onto a tube and/or another support structure, such as a register sign.

18 Claims, 8 Drawing Sheets

(56) References Cited

U.S. PATENT DOCUMENTS

| | | | | |
|---|---|---|---|---|
| 4,081,921 | A * | 4/1978 | Humphrey | G09F 1/06 248/459 |
| 4,112,604 | A * | 9/1978 | Ott | G09F 15/0056 40/605 |
| 4,512,541 | A | 4/1985 | Lietzke | |
| 4,738,041 | A * | 4/1988 | Drueck, Jr. | G09F 1/06 248/524 |
| 4,771,560 | A | 9/1988 | Richards | |
| 6,478,268 | B1 | 11/2002 | Bidwell et al. | |
| 10,896,629 | B1 | 1/2021 | Frost | |
| 2008/0276420 | A1 | 11/2008 | Johnson | |
| 2012/0297653 | A1 | 11/2012 | Ridless et al. | |

OTHER PUBLICATIONS

"Final Office Action received for U.S. Appl. No. 15/194,227, dated Dec. 2, 2019, 18 Pages", 18.
"Final Office Action Received for U.S. Appl. No. 15/194,227, dated Jun. 14, 2019, 17 Pages".
"Final Office Action received for U.S. Appl. No. 15/194,227, dated Jun. 5, 2018, 11 pages".
"Non Final Office Action Received for U.S. Appl. No. 15/194,227, dated Dec. 11, 2018, 15 pages".
"Non Final Office Action Received for U.S. Appl. No. 15/194,227, dated Aug. 24, 2017."
"Notice of Allowance received for U.S. Appl. No. 15/194,227, dated Sep. 16, 2020."

* cited by examiner

MODULAR SIGN

CROSS-REFERENCE TO RELATED APPLICATIONS

This application is a continuation-in-part application of each of the following:

U.S. patent application Ser. No. 14/960,747, filed Dec. 7, 2015, now U.S. Pat. No. 10,654,611, which claims priority pursuant to 35 U.S.C. 119(e) to U.S. Provisional Patent Application Ser. No. 62/088,163, filed Dec. 6, 2015, the entire disclosures of which are incorporated herein by reference.

U.S. patent application Ser. No. 15/194,227, filed Jun. 27, 2016, which claims priority pursuant to 35 U.S.C. 119(e) to U.S. Provisional Patent Application Ser. No. 62/184,731, filed Jun. 25, 2015, the entire disclosures of which are incorporated herein by reference.

FIELD OF THE INVENTION

The present invention relates generally to signage. More specifically, the present invention is concerned with a corrugated, paperboard sign that is manufactured in a fold and glue assembly process and that is traditionally provided to an end user in a collapsed or knock-down configuration for setup.

BACKGROUND OF THE INVENTION

Corrugated signs and containers are often made from pieces of flat paperboard stock material that are die cut into shapes that define various panels. The shapes are folded along predefined lines between the panels with overlapping sides, strips, or panels that are glued, taped or otherwise affixed to another panel to form an enclosed boundary. The panels are folded and/or glued into place to become the walls of the sign or container. The signs and/or containers are traditionally provided to product manufacturers and/or retailers in a collapsed or knock-down configuration for storage, handling, and shipping. The manufacturer and/or retailers open the knock-down signs or containers and fold them appropriately to erect the assembled sign or container for display.

Many retailers, such as grocery stores, convenience stores, department stores, etc., utilize a variety of signs, such as tube signs and/or slip signs. Tube signs are configured to rest on top of a standard tube, such as a fiberboard or paper tube or core. In this way, tube signs are capable of being positioned throughout a store. Slip signs, on the other hand, are configured to slip over existing structures, such as a register sign on top of a register pole. In this way, the existing structure serves as a support structure for the slip sign.

Knock-down tube signs and knock-down slip signs of the prior art are fabricated much like knock-down boxes with each sign having opposed front and rear panels extending between opposed side panels and opposed top and bottom panels so as to define an interior area. In some embodiments, the front panel and/or the rear panel serves as a graphic panel. In other embodiments, graphic panels include a unique shape and/or are otherwise required to extend past the one or more other panel, such as the bottom panel, so as to accommodate marketing needs, such as providing a sign that has the same general shape of a product, and/or providing structural needs, such as to define a channel that is configured to slip over a register sign. Because knock-down signs of the prior art are rectangular in shape, these unique features require a separate graphic panel to be coupled to the front panel and/or the rear panel.

Existing methods of erecting the knock-down tube and slip signs of the prior art include providing a store with a plurality of blank signs in a knock-down configuration and a plurality of separate graphic panels. A worker, such as a store employee, then folds the various panels of the sign along multiple fold lines to form a box structure, tapes, glues or otherwise secures the panels together so as to retain the box shape, and affixes one or more graphic panel to the box structure. After the box structure is erected and the graphic panels are affixed to the box structure, the sign can be secured to a tube and/or other structure, such as a register sign. This process is cumbersome and time consuming and must be completed by hand in the store. Moreover, in such prior art sign structures, even if the graphic panels could be pre-glued to the blank knock-down, it would be extremely difficult (if not impossible) to erect the box structure with the panels attached. Thus, it would be beneficial to provide a corrugated paperboard signage assembly that is configured to secure one or more graphic panel to a tube and/or other structure, such as a register sign, that transforms quickly and easily from a knock-down configuration to an erected configuration.

SUMMARY OF THE INVENTION

The present invention comprises a corrugated paperboard modular sign that includes a spacer assembly coupled to a back surface of one or more graphic panel. The modular sign is movable between a knock-down configuration and an erected configuration. In the knock-down configuration, the spacer assembly lays flat against the back surface of the one or more graphic panel. In this way, the modular sign can be easily shipped and/or stored. In the erected configuration, the modular sign is configured to be supported by a tube and/or an existing structure, such as a register sign on top of a register pole.

In a preferred embodiment, as shown in FIG. 1, the spacer assembly is coupled to two graphic panels. Although the graphic panels depicted in FIG. 1 are the same size and have the same rectangular shape, it will be appreciated that graphic panels having a variety of shapes and sizes can be used. In some embodiments, the graphic panels are die cut from a first piece of material and the spacer assembly is die cut from a second piece of material. In other embodiments, the graphic panels and the spacer assembly are die cut from the same piece of material with the single piece of material being folded over on itself so that the spacer assembly rests flat against the back surface of each graphic panel.

In preferred embodiments, the spacer assembly is moveable from a flat configuration to a three-dimensional configuration. In some embodiments, the spacer assembly includes one or more feature, such as a key flap and a corresponding key aperture, to selectively secure the spacer assembly in the three-dimensional configuration. In some such embodiments, moving the spacer assembly from its flat configuration to its three-dimensional configuration causes the modular sign to move from its knock-down configuration to its erected configuration. In other such embodiments, securing the spacer assembly in its three-dimensional configuration causes the modular sign to be secured in its erected configuration.

In some embodiments, the spacer assembly defines one or more feature, such as an aperture, that is configured to receive a support member. In some such embodiments, a key flap of the front top panel is configured to couple to the support member. For instance, in some embodiments, the support member is a fiber or paper tube that defines an exterior diameter and an interior diameter. In some such embodiments, an aperture of the support structure is configured to receive the exterior diameter of the fiber tube and the key flap is configured to be received by the interior diameter of the fiber tube.

In a preferred embodiment, the modular sign includes front and rear graphic panels coupled to respective front and rear panels of the spacer assembly. In some embodiments, the graphic panels extend past the edges of the spacer assembly panels so as to fully or partially conceal the spacer assembly when the modular sign is in the erected configuration. In other embodiments, the graphic panels extend below a bottom panel of the spacer assembly so as to create a channel that is configured to receive one or more support structure, such as the top of a register sign. In this way, the modular sign can be slid over the support structure so as to be supported by the support structure.

In some embodiments, the spacer assembly includes one or more securing feature so as to secure the modular sign relative to the support structure. In some such embodiments, the securing feature corresponds with an end profile that is configured to receive a vertical support member positioned adjacent to the support structure, such as a vertical pole positioned adjacent to a register sign. In this way, the module sign can be slid onto the support structure and towards the vertical member until the end profile receives the vertical member so as to more securely couple the modular sign to the support structure.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION OF THE DRAWINGS

A preferred embodiment of the invention, illustrative of the best mode in which the applicant has contemplated applying the principles, is set forth in the following description and is shown in the drawings and is particularly and distinctly pointed out and set forth in the appended claims.

DETAILED DESCRIPTION OF A PREFERRED EMBODIMENT

Figure 1:
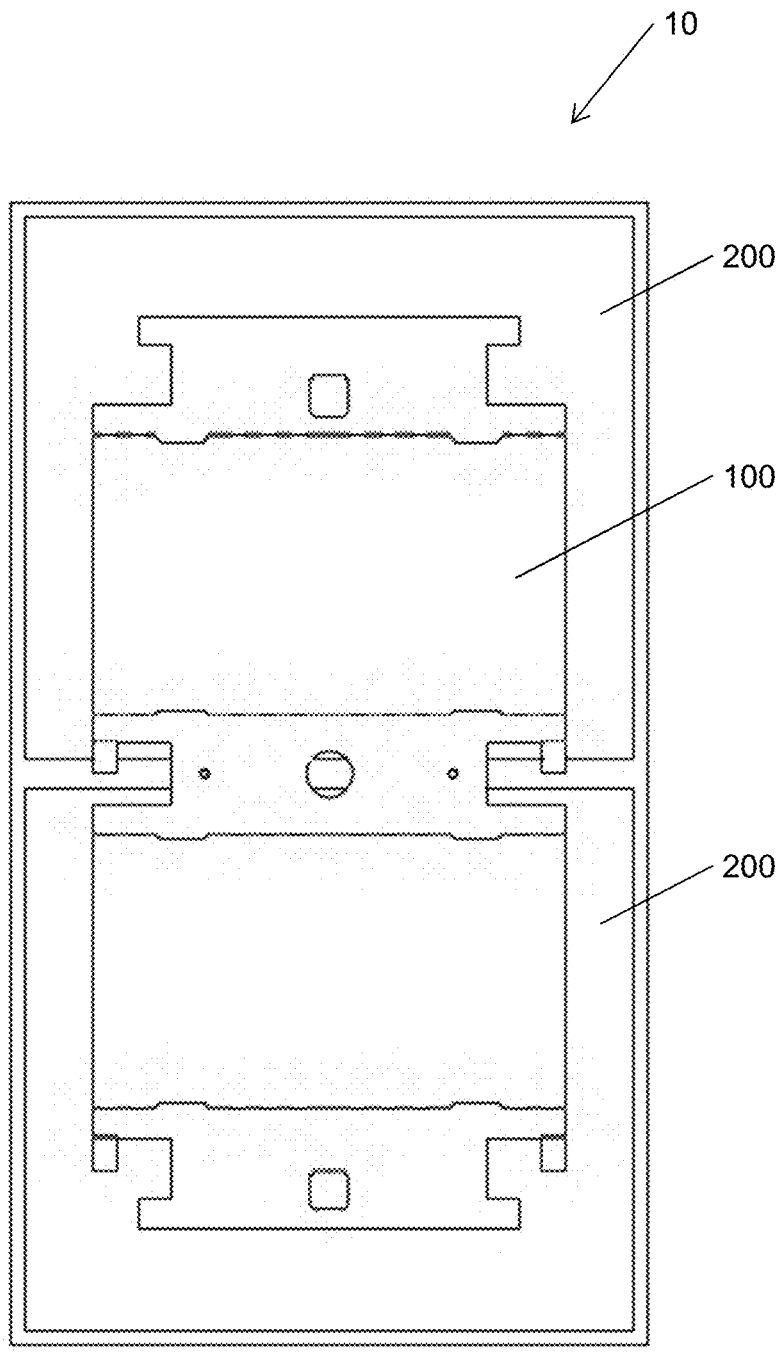
FIG. 1 is a top view of the modular sign shown in a knock-down configuration with excess material surrounding the graphic panels.
Figure 2:
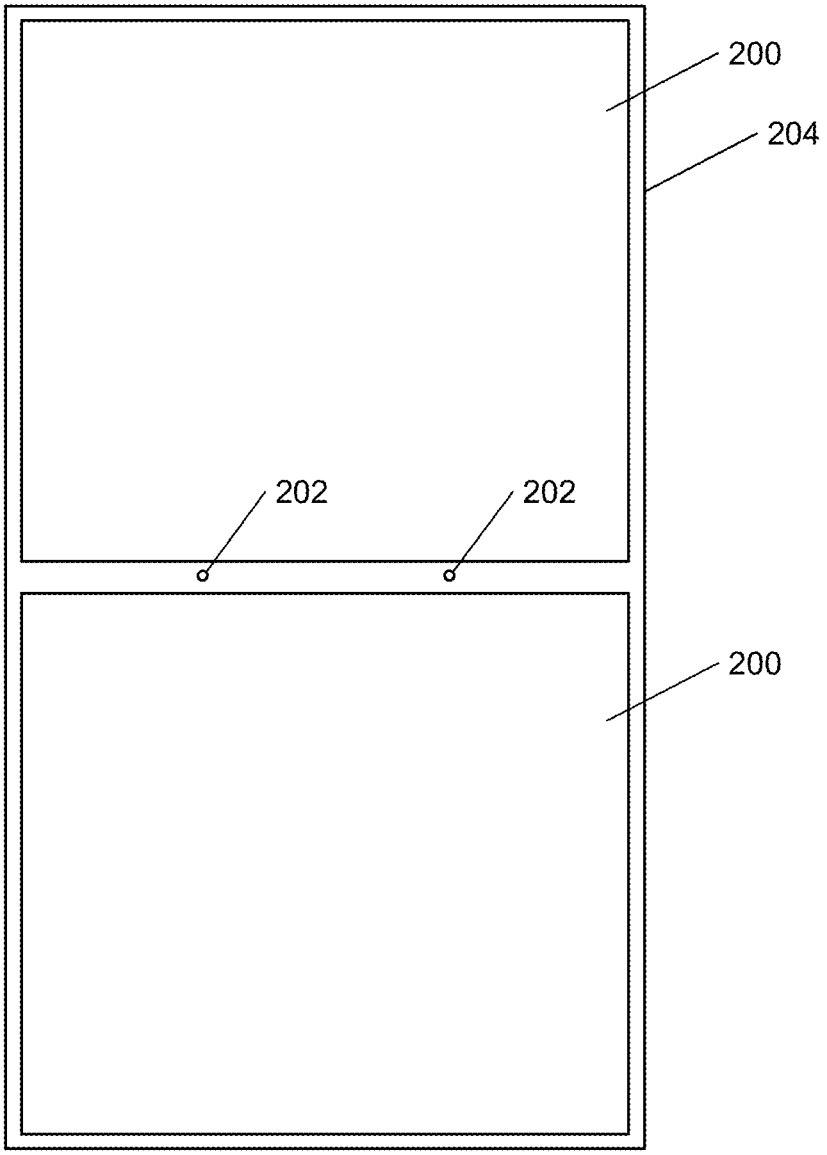
FIG. 2 is a top view of a first piece of material that has been die cut into two rectangular graphic panels and excess material that includes indexing holes.

As required, a detailed embodiment of the present invention is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The present invention is directed to a modular sign 10 that includes a spacer assembly 100 coupled to a back surface of one or more graphic panel 200. The modular sign 10 is movable between a knock-down configuration and an erected configuration. In the knock-down configuration, the spacer assembly 100 lays flat against the back surface of the one or more graphic panel 200. In this way, the modular sign 10 can be easily shipped and/or stored. In the erected configuration, the modular sign is configured to be supported by a vertical support member and/or other support structure, such as a register sign on top of a register pole.

In some embodiments, excess material 204 surrounds the graphic panel 200. In some such embodiments, the excess material 204 protects one or more edge of the graphic panel 200. In other embodiments, the excess material 204 is helpful in positioning the graphic panel 200 relative to another graphic panel 200 and/or relative to the spacer assembly 100. In some such embodiments, the excess material 204 is not removed until after the spacer assembly 100 is secured to each graphic panel 200. In other embodiments, excess material (not shown) surrounds the spacer assembly 100. In some embodiments, the graphic panels 200 and/or the spacer assembly 100 are shipped and/or stored with excess material so as to provide additional protection to the graphic panels 200 and/or the spacer assembly 100 when the modular sign 10 is in the knock-down configuration. In such embodiments, a user simply removes the excess material prior to moving the modular sign to the erected configuration.

Figure 3:
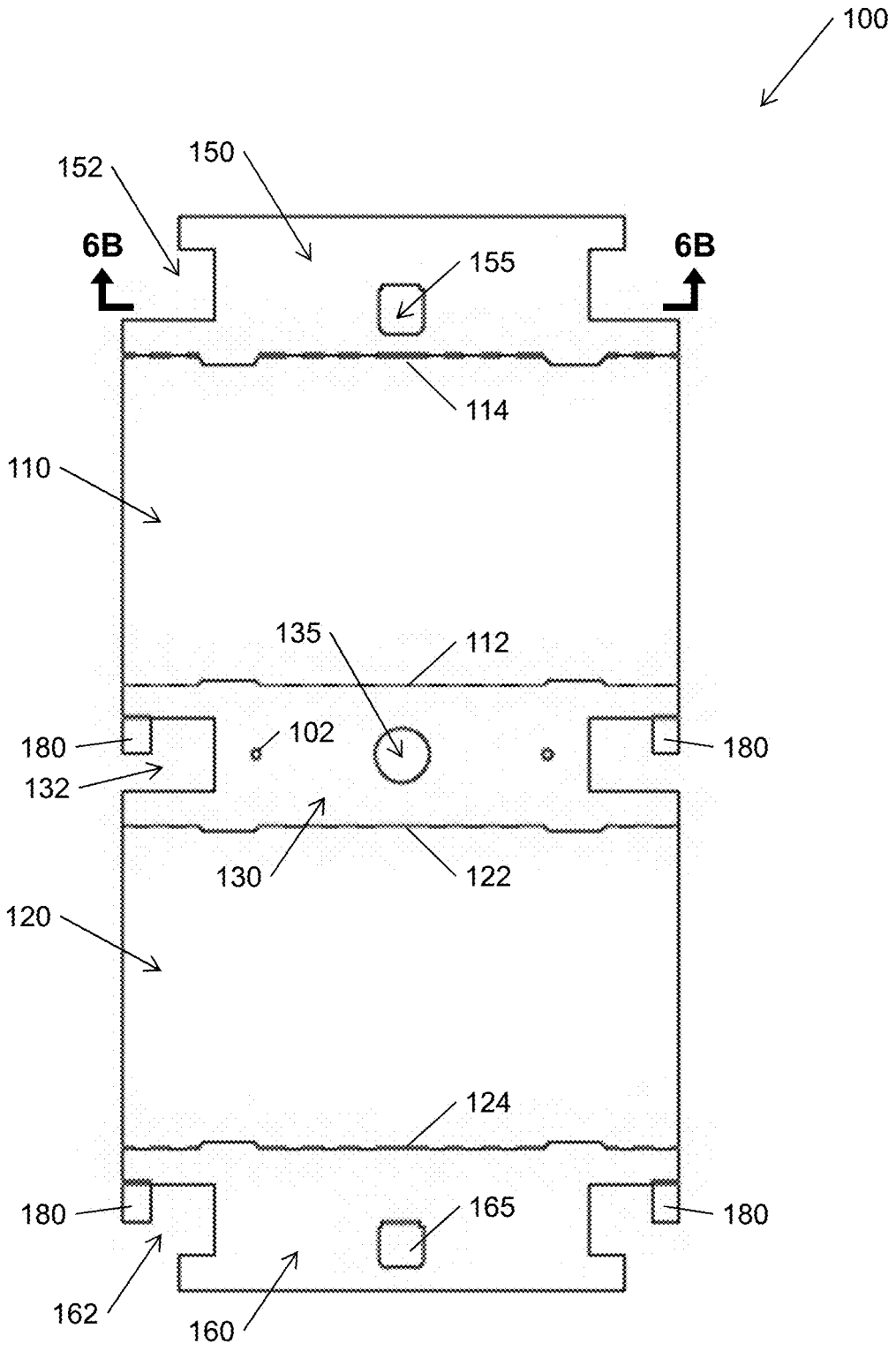
FIG. 3 is a top view of the spacer assembly when the spacer assembly is in a flat configuration.
Figure 4A:
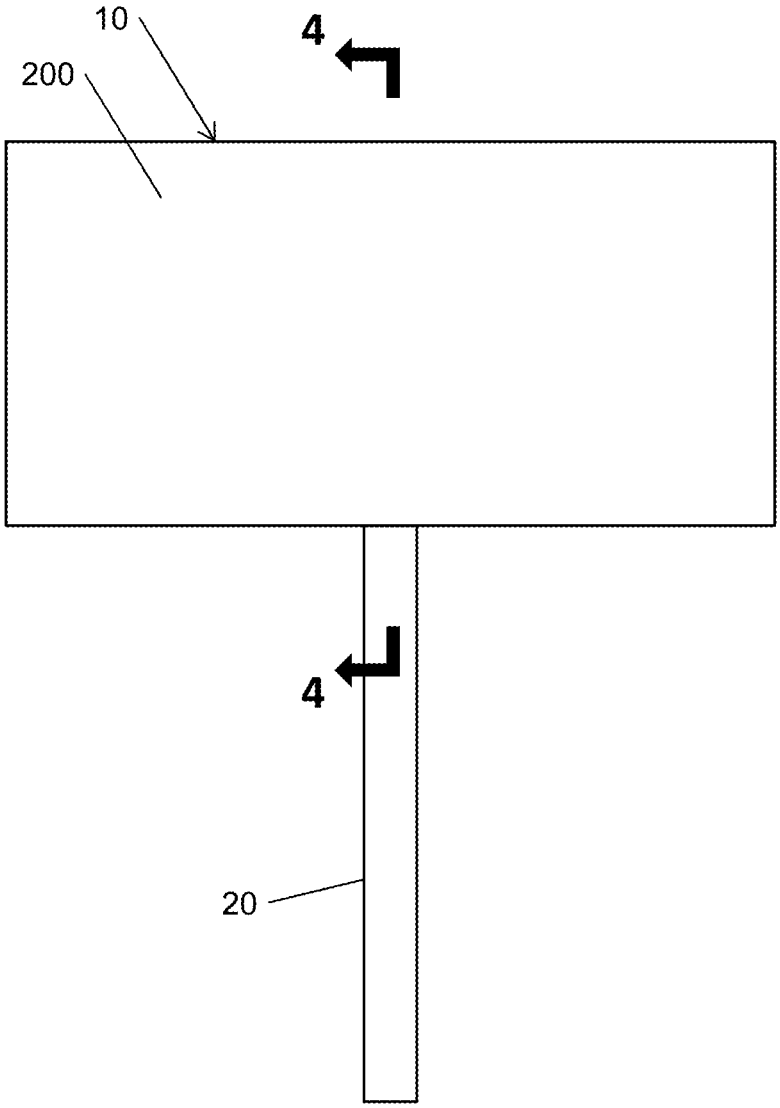
FIG. 4A is a front view of a modular sign supported by a vertical support member.
Figure 4B:
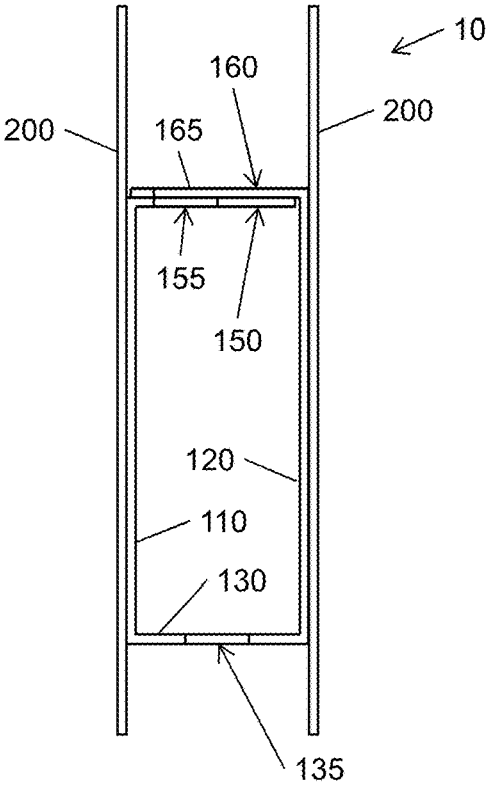
FIG. 4B is a sectional view taken along line 4-4 of FIG. 4A with the modular sign being removed from the vertical support member, a key flap being shown in a stowed configuration.
Figure 4C:
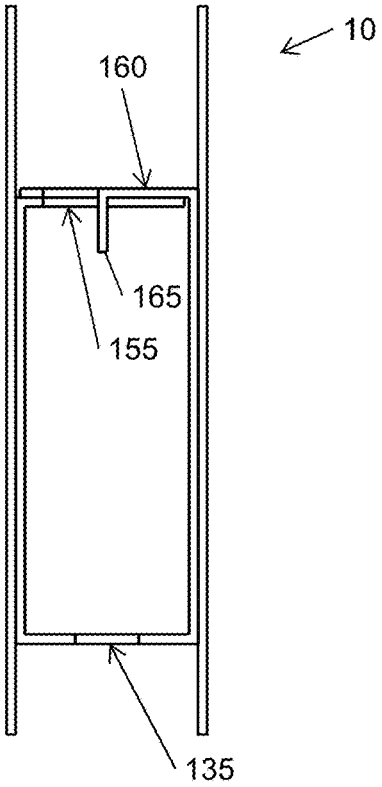
FIG. 4C is a sectional view taken along line 4-4 of FIG. 4A with the modular sign being removed from the vertical support member, the key flap being shown in a deployed configuration.
Figure 4D:
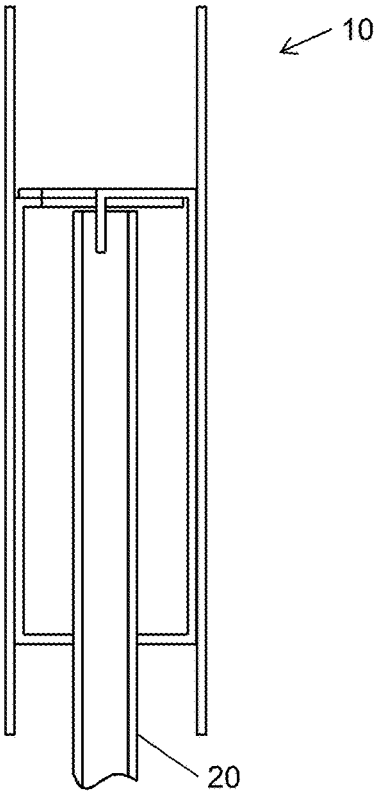
FIG. 4D is a sectional view taken along line 4-4 of FIG. 4A, the key flap being received by an interior area of the vertical support member.
Figure 4E:
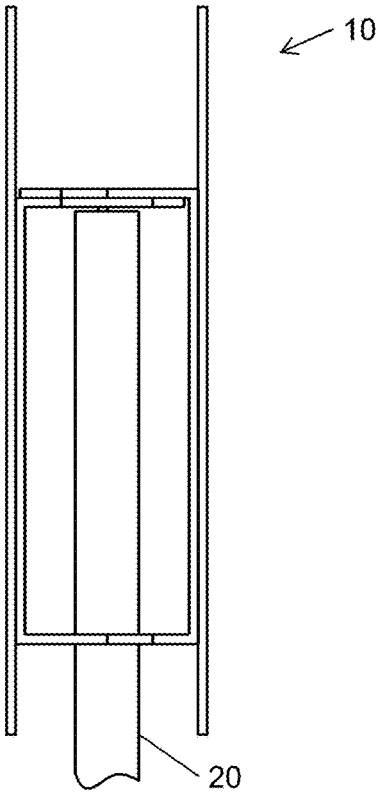
FIG. 4E is a side view of the modular sign of FIG. 4A.
Figure 5A:
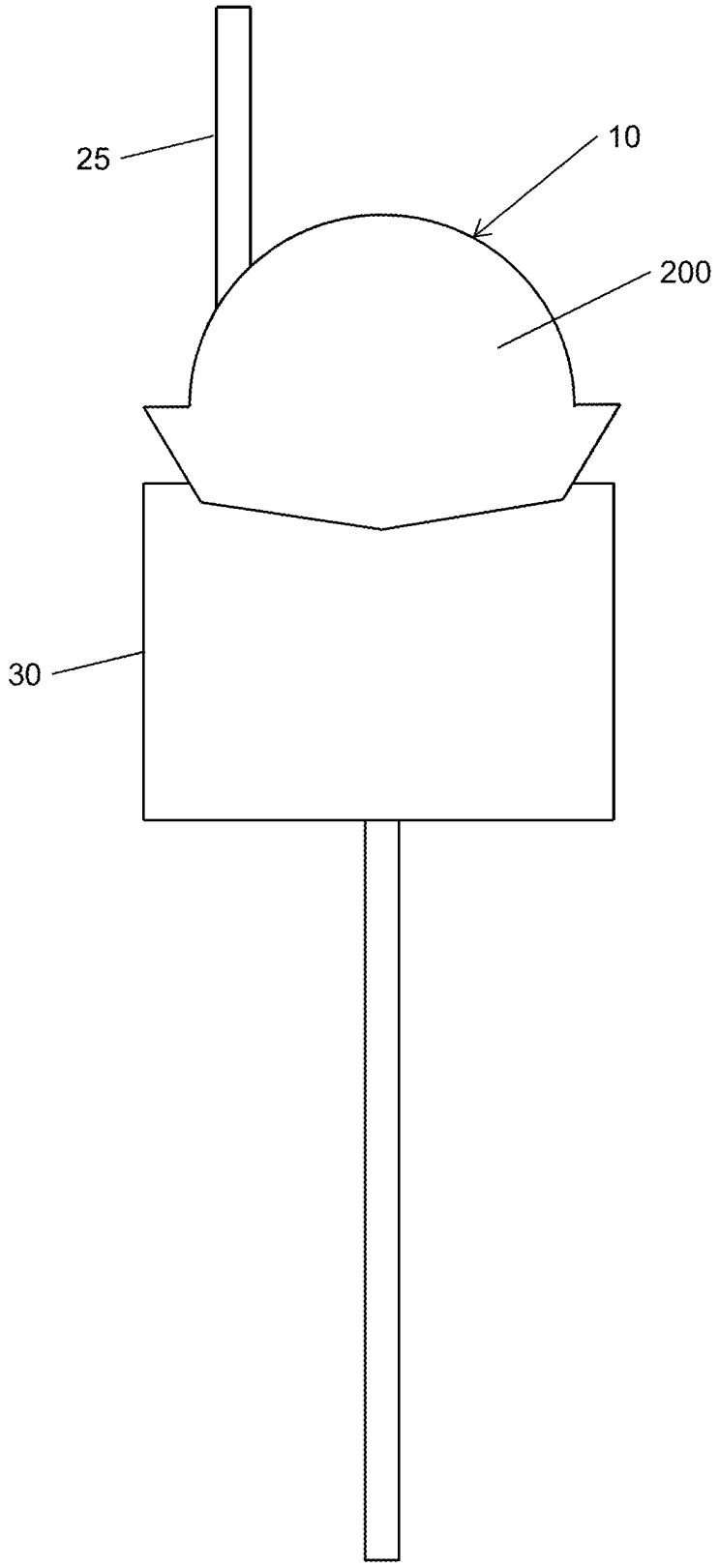
FIG. 5A is a front view of a modular sign supported by a support structure and secured to a vertical support member.
Figure 5B:
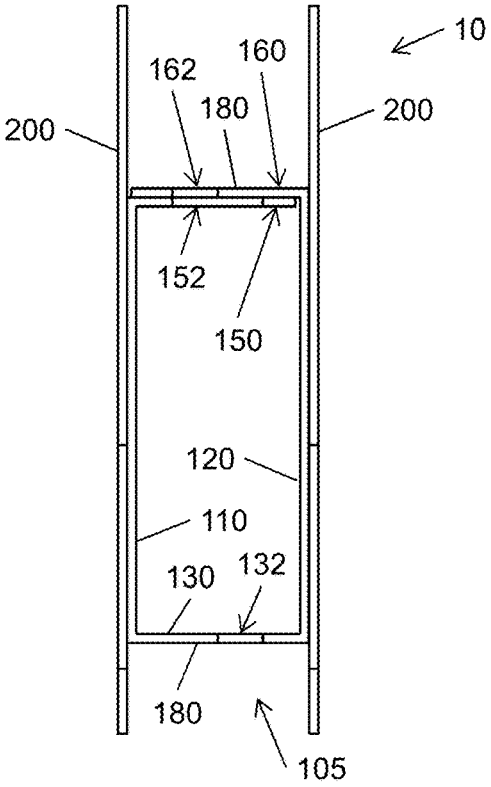
FIG. 5B is a side view of the modular sign of FIG. 5A with the modular sign being removed from the support structure and vertical support member, securing features being shown in respective stowed configurations.
Figure 5C:
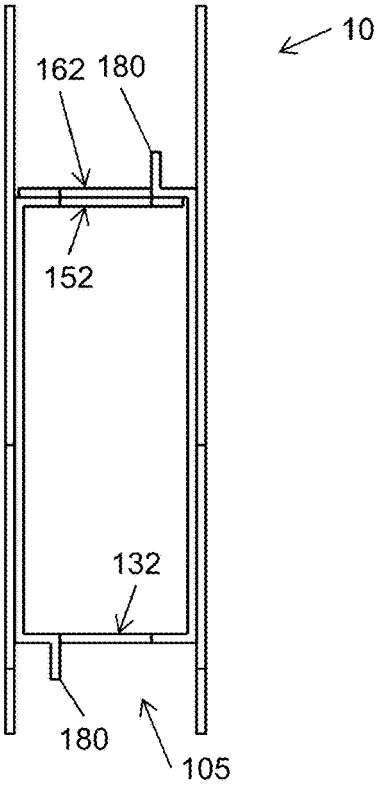
FIG. 5C is a side view of the modular sign of FIG. 5A with the modular sign being removed from the support structure and vertical support member, the securing features being shown in respective retracted configurations.
Figure 5D:
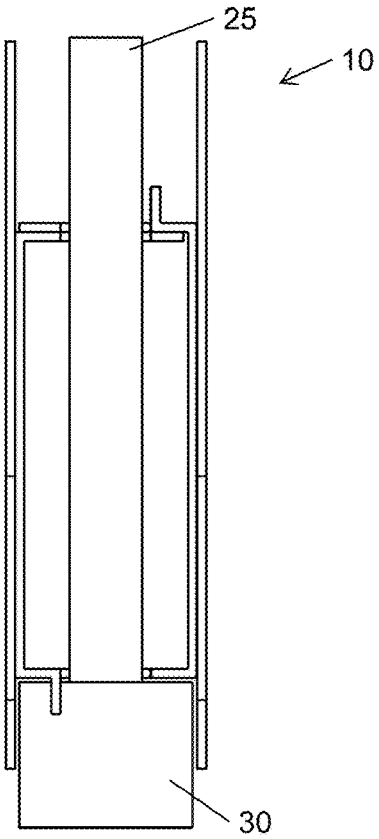
FIG. 5D is a side view of the modular sign of FIG. 5A, the securing features being shown in respective unlocked configurations.
Figure 5E:
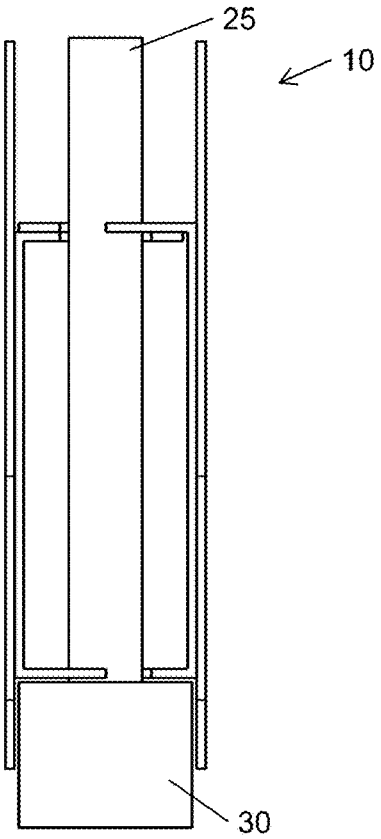
FIG. 5E is a side view of the modular sign of FIG. 5A, the securing features being shown in respective locked configurations.
Figure 6A:
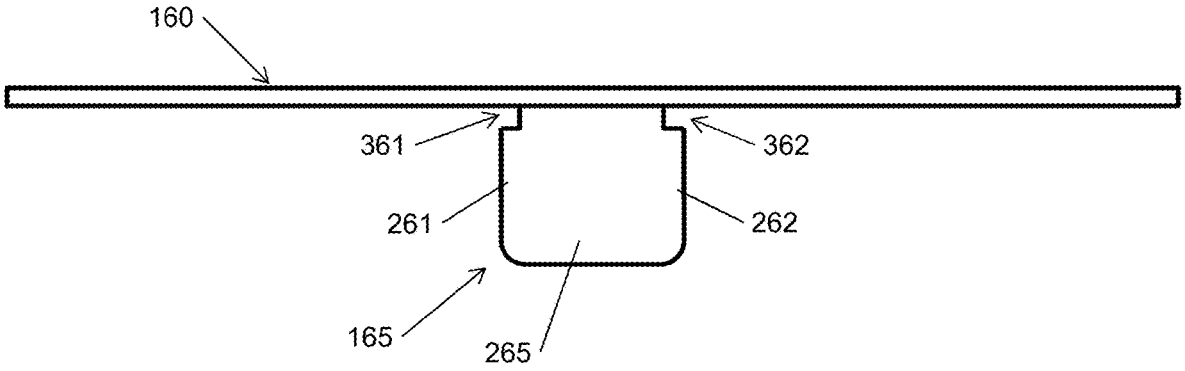
FIG. 6A shows an elevation side view of a rear top flange of the present invention shown with a key flap in a deployed configuration such that the rear top flange defines left and right key slots.
Figure 6B:
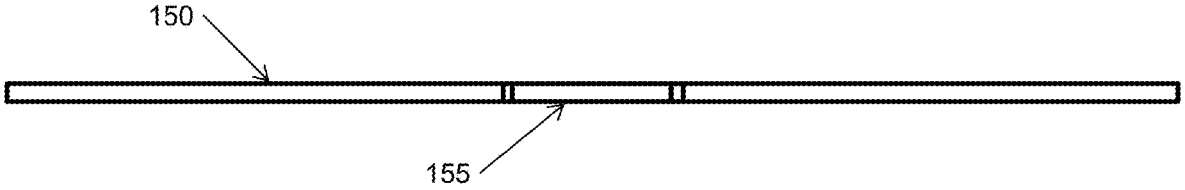
FIG. 6B is a sectional view of a front top flange of the present invention taken along line 6B-6B of FIG. 3, line 6B-6B extending through a key aperture defined by the front top flange.
Figure 6C:
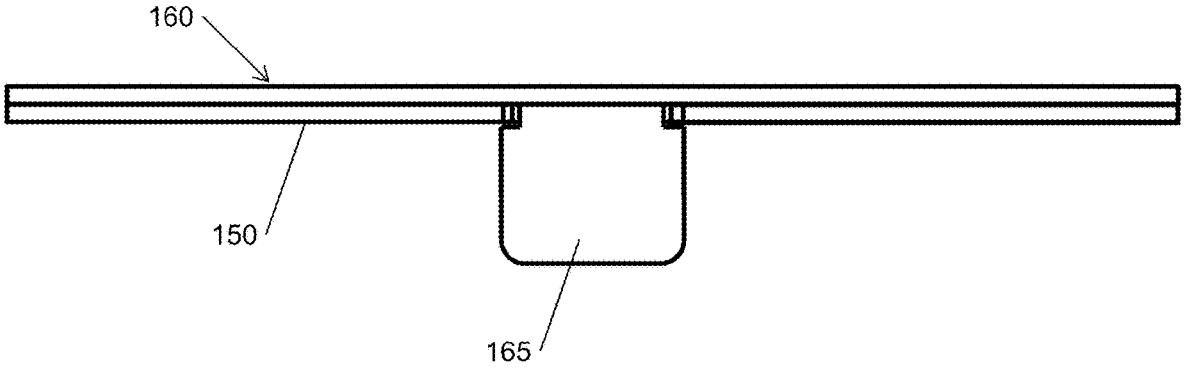
FIG. 6C shows the key flap of FIG. 6A extending through the key aperture of FIG. 6B such that a portion of the front top flange of FIG. 6B extends into each of the left and right key slots.

In some embodiments, as shown in FIGS. 1 and 3, the modular sign includes a spacer assembly indexing feature 102 that is associated with the spacer assembly 100. In some such embodiments, the modular sign further includes a corresponding graphic panel indexing feature 202 that is associated with one or more graphic panel 200. In some embodiments, alignment of the spacer assembly indexing feature 102 with the graphic panel indexing feature 202 causes the spacing feature 100 to align with the one or more graphic panel 200. In this way, the indexing features 102, 202 assist in positioning and orienting the spacer assembly 100 relative to the graphic panels 200. In some such embodiments, the spacer assembly indexing feature is included in the excess material surrounding the spacer assembly 100. In other such embodiments, the graphic panel indexing feature 204 is included in the excess material 204 surrounding the one or more graphic panel 200 so that the indexing features do not interfere with the graphic panels themselves.

In a preferred embodiment, the spacer assembly 100 includes opposed front 110 and rear 120 panels, each having opposed proximal 112, 122 and distal 114, 124 ends. In some such embodiments, the spacer assembly 100 further includes a bottom panel 130 extending between respective proximal ends 112, 122 of the front 110 and rear 120 panels. In other such embodiments, the spacer assembly 100 further includes a front top flange 150 extending from the distal end 114 of the front panel 110. In still other such embodiments, the spacer assembly 100 further includes a rear top flange 160 extending from the distal end 124 of the rear panel 120.

In preferred embodiments, the spacer assembly 100 is moveable between a flat configuration and a three-dimensional configuration. In some embodiments, the spacer assembly 100 is in the flat configuration when the modular sign 10 is in the knock-down configuration. In other embodiments, the spacer assembly 100 is in the three-dimensional configuration when the modular sign 10 is in the erected configuration. In still other embodiments, the spacer assembly 10 is moved from its flat configuration to its three-dimensional configuration when the modular sign 10 is moved from its knock-down configuration to its erected configuration.

In some embodiments of the present invention, the front top flange 150 is displaced from the rear top flange 160 when the spacer assembly 100 is in the flat configuration. In some such embodiments, the rear top flange 160 is folded over the front top flange 150 when the spacer assembly 100 is in the three-dimensional configuration. In some embodiments, the rear top flange 160 defines a key flap 165 and the front top flange 150 defines a key aperture 155 such that when the spacer assembly 100 is in the three-dimensional configuration, the key aperture 155 is configured to selectively receive the key flap 165 so as to lock the rear top flange 160 to the front top flange 150, thereby creating a top panel.

In some embodiments, the key flap 165 is moveable between a stowed configuration and a deployed configuration. In some such embodiments, the key flap 165 is in the stowed configuration when the spacer assembly 100 is in its flat configuration and/or when the modular sign is in its knock-down configuration. In other such embodiments, moving the key flap 165 from the stowed configuration to the deployed configuration when the spacer assembly 100 is in the three-dimensional configuration allows the key flap 165 to be received by the key aperture 155, thereby moving the spacer assembly 100 and/or the modular sign 10 from an unlocked configuration to a locked configuration.

In some embodiments, the key flap includes opposed proximal and distal ends and opposed left and right sides extending therebetween. In some such embodiments, a central portion of the proximal end of the key flap is hingedly coupled to the rear top flange of the spacer assembly such that the key flap 165 is moveable between the stowed configuration and the deployed configuration. In some embodiments, the left side of the key flap is generally parallel with the right side of said key flap. In some embodiments, the key flap is parallel with the top panel when the key flap is in the stowed configuration and is angled away from the top panel and is configured to interface with a top end of a vertical support member so as to provide lateral support for the modular sign when the key flap is in the deployed configuration. In some embodiments, the left and right sides of the key flap are defined by respective left 261 and right 262 tabs extending from a central portion 265 of the key flap 165, the left 261 and right 262 tabs being configured so as to define respective left 361 and right 362 key slots positioned between the rear top panel and the left and right tabs when the key flap is in the deployed configuration. In some embodiments, the key flap extends vertically downward from the top panel when the key flap is in the deployed configuration. In some embodiments, the key flap is formed from the rear top flange and the front top flange defines a key aperture that is configured to receive the key flap by moving the key flap from the stowed configuration to the deployed configuration when the spacer assembly is in the three-dimensional configuration, thereby moving the spacer assembly from an unlocked configuration to a locked configuration by causing the key flap to engage with the front top flange such that the front top flange extends into the left and right key slots.

In some embodiments, the spacer assembly 100 is retained in its three-dimensional configuration when it is in the locked configuration. In some such embodiments, the spacer assembly 100 is moveable from its locked configuration to its unlocked configuration by moving the key flap 165 from its deployed configuration to its stowed configuration, thereby removing the key flap 165 from the key aperture 155. In some such embodiments, the spacer assembly 100 is moveable from its three-dimensional configuration to its flat configuration when it is in its unlocked configuration.

In some embodiments, the modular sign 10 is retained in its erected configuration when it is in the locked configuration. In some such embodiments, the modular sign 10 is moveable from its locked configuration to its unlocked configuration by moving the key flap 165 from its deployed configuration to its stowed configuration, thereby removing the key flap 165 from the key aperture 155. In some such embodiments, the modular sign 10 is moveable from its erected configuration to its knock-down configuration when it is in its unlocked configuration.

In some embodiments, the bottom panel 130 defines an aperture 135 that is configured to receive a vertical support member 20, such as a pole or tube. In some embodiments, the spacer assembly 100 is configured such that the modular sign 10 is capable of sliding over a top end of the vertical support member 20. In some such embodiments, the top panel is configured to interface with the top end of the vertical support member 20 so as to provide vertical support for the modular sign 10. In some embodiments, the key flap 165 is configured to interface with the top end of the vertical support member 20 so as to provide lateral support for the modular sign. For instance, in some embodiments, the vertical support member is a fiber or paper tube that defines an exterior diameter and an interior diameter. In some such embodiments, the aperture 135 of the bottom panel 130 is configured to receive the exterior diameter of the fiber tube and the key flap 165 is configured to be received by the interior diameter of the fiber tube. In some embodiments, the key flap is engaged with the front top panel, such that the angle of the key flap relative to the top panel of the modular sign remains constant as the key flap is inserted through the top opening of the vertical support member.

In a preferred embodiment, the modular sign includes a graphic panel 200 coupled to the front panel 110 of the spacer assembly 100. In some embodiments, the graphic panel 200 extends past the proximal 112 and distal 114 ends of the front panel 110 so as to fully or partially conceal the spacer assembly 100 when the modular sign is in the erected configuration.

In some embodiments, the modular sign includes a graphic panel 200 coupled to each of the front 110 and rear 120 panels. In some such embodiments, the graphic panels 200 extend below the bottom panel 130 of the spacer assembly so as to create a channel 105 that is configured to receive one or more support structure, such as the top of a register sign. In this way, the modular sign 10 can be slid over the support structure so as to be supported by the support structure.

In some embodiments, the spacer assembly 100 includes one or more securing feature 180 extending from one or more panel, such as the top panel and/or the bottom panel. In some such embodiments, the securing feature 180 is configured to selectively secure the modular sign 10 relative to the support structure. In some such embodiments, the securing feature 180 is positioned adjacent to an end profile 132 in the bottom panel 130, an end profile 152 in the front top flange 150, and/or an end profile 162 in the rear top flange 160.

In some embodiments, the securing feature 180 is movable between a stowed configuration and a deployed configuration. In the stowed configuration, the securing feature 180 is relatively flat with a corresponding panel, such as a top panel or a bottom panel, so as to accommodate storage of the spacer assembly 100. In the deployed configuration, the securing feature 180 is folded up and away from the corresponding panel so as to accommodate moving the securing feature past a vertical support member.

In some embodiments, the securing feature 180 is configured to interface with a vertical support member, such as a vertical pole positioned adjacent to the support structure. In some such embodiments, the module sign 10 can be slid onto the support structure and towards the vertical support member until the end profile receives the vertical support member.

In some embodiments, the securing feature 180 is movable between a locked configuration and an unlocked configuration. In the unlocked configuration, the securing feature 180 allows the modular sign to be moved into position relative to a support structure by allowing the vertical support member to be received by one or more end profile. In the locked configuration, the securing feature 180 prevents or otherwise inhibits the modular sign 10 from moving away from the support structure by preventing the modular sign 10 from moving away from the vertical member. In some embodiments, the stowed configuration In some embodiments, as shown in FIG. 1, the securing feature 180 is a tab member extending adjacent to the end profile 132 of the bottom panel 130. In other embodiments, not shown, the front top flange 150 includes a tab member (not shown) extending adjacent to the end profile 152 of the front top flange 150. In still other embodiments, as shown in FIG. 1, the securing feature 180 is a tab member extending adjacent to the end profile 162 of the rear top flange 160.

In use, a user, such as a store employee, can quickly and easily move the modular sign 10 from the knock-down configuration to the erected configuration by: removing excess material from the graphic panels and/or the spacer assembly (if necessary); placing the modular sign 10 on a flat surface with a front surface of each graphic panel 200 resting on the flat surface; rotating the front and rear graphic panels up and away from the flat surface such that the front 110 and rear 120 panels of the spacer assembly 100 are approximately perpendicular to the bottom panel 130; and folding the front 150 and rear 160 top flanges against each other so as to create a top panel extending between the front 110 and rear 120 panels. The user can then quickly and easily secure the modular sign in the erected configuration by folding the key flap 165 of the rear top flange 160 down into the key aperture 155 of the front top flange 150.

After the modular sign 10 is in the erected configuration, the user can selectively install the modular sign onto a vertical support member, such as a tube, and/or onto another support structure, such as a register sign. To additionally secure the modular sign to the tube, the user can selectively insert the key flap of the spacer assembly 100 into an interior diameter of the tube. To additionally secure the modular sign to a register sign, the user can selectively move one or more securing feature 180 from a stowed and/or locked configuration to a deployed and/or unlocked configuration, such as by rotating the securing feature away from a corresponding panel. In some embodiments, the user can then slide the modular sign 10 towards a vertical member until the vertical member is received by an end profile of one or more panel of the spacer assembly. In some embodiments, the user can then selectively move the securing feature to a stowed and/or locked configuration so as to secure the modular sign to the vertical member.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Although the foregoing detailed description of the present invention has been described by reference to an exemplary embodiment, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall with in the true spirit and scope of the underlying principles disclosed and claimed herein. Consequently, the scope of the present invention is intended to be limited only by the attached claims, all matter contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

What is claimed is:

1. A modular sign that is moveable between a knockdown configuration and an erected configuration, the sign comprising a spacer assembly, the spacer assembly comprising:

a front top flange defining a key aperture;

a rear top flange comprising a key flap, said key flap being moveable between a stowed configuration and a deployed configuration; and opposed front and rear panels hingedly coupled to respective front and rear top flanges, wherein the spacer assembly moves from a flat configuration to a three-dimensional configuration when the modular sign is moved from the knock-down configuration to the erected configuration, wherein said front and rear panels are generally parallel with each other and are generally parallel with each of said front and rear top flanges when said spacer assembly is in the flat configuration, wherein said rear top flange extends at least partially over said front top flange when said spacer assembly is in the three-dimensional configuration, thereby forming a top panel, wherein said front and rear panels are generally parallel with each other and are generally perpendicular to said top panel when said spacer assembly is in the three-dimensional configuration, wherein said key flap is perpendicular to said rear top flange when said key flap is in the deployed configuration, and wherein said key flap comprises:

a central portion comprising opposed proximal and distal ends, said proximal end of said central portion of said key flap being hingedly coupled to said rear top flange; and left and right tabs extending from respective left and right sides of said central portion, wherein said left and right tabs are displaced from said proximal end of said central portion such that said rear top flange defines respective left and right key slots extending between a bottom surface of said rear top panel and respective top edges of said left and right tabs when said key flap is in the deployed configuration.

2. The sign of claim 1, wherein said key flap extends through said key aperture, thereby securing said spacer assembly in a locked configuration.

3. The sign of claim 2, wherein a periphery of said key flap defines:

said central portion comprising opposed proximal and distal ends, said proximal end of said central portion of said key flap being hingedly coupled to said rear top flange;

said left and right key tabs extending from respective left and right sides of said central portion, wherein said left and right tabs are displaced from said proximal end of said central portion such that said rear top flange defines respective left and right key slots extending between said bottom surface of said rear top panel and respective top edges of said left and right tabs when said key flap is in the deployed configuration; and wherein a periphery of said key aperture is configured to selectively receive said key flap wherein said key flap is in the deployed configuration, such that said front top flange engages with said respective left and right key slots.

4. The sign of claim 3, wherein said front top flange is engaged with said key flap in the deployed configuration by extending said front top flange into respective left and right key slots when said spacer assembly is in the locked configuration.

5. The sign of claim 4, further comprising a vertical support member defining an interior area, said vertical support member extending through a bottom panel of said spacer assembly towards said top panel of said spacer assembly, a top end of the vertical support member defining a top opening in communication with said interior area of said vertical support member, wherein said key flap extends through said top opening of said vertical support member such that a distal end of said key flap is positioned in said interior area of said vertical support member, and wherein a width of said key flap is equal to an inner diameter of said vertical support member.

6. The sign of claim 5, wherein said bottom panel defines an end profile that is moveable between an open configuration and a closed configuration, wherein the open configuration of said end profile is configured to allow the sign to move in and out of lateral engagement with a vertical member, and wherein the closed configuration of said end profile is configured to restrict lateral movement of the sign relative to the vertical member.

7. The sign of claim 6, further comprising a securing feature extending from said bottom panel, wherein said securing feature is moveable between a stowed configuration and deployed configuration, thereby moving said end profile of said bottom panel between the closed configuration and the open configuration, respectively, wherein said securing feature is parallel with said bottom panel when said securing feature is in the stowed configuration, and wherein said securing feature is angled away from said bottom panel when said securing feature in the deployed configuration.

8. The sign of claim 7, further comprising an additional securing feature extending from a first end of said top panel, said first end of said top panel defining an end profile.

9. The sign of claim 1, further comprising a vertical support member defining an interior area, said vertical support member extending through a bottom panel of said spacer assembly towards said top panel of said spacer assembly, a top end of the vertical support member defining a top opening in communication with said interior area of said vertical support member, wherein said key flap extends through said top opening of said vertical support member such that a distal end of said key flap is positioned in said interior area of said vertical support member, and wherein a width of said key flap is equal to an inner diameter of said vertical support member.

10. A method of forming a modular sign that is moveable between a knockdown configuration and an erected configuration, the method comprising:

forming a spacer assembly in a flat configuration, said spacer assembly having:

a front top flange defining a key aperture;

a rear top flange comprising a key flap, said key flap being moveable between a stowed configuration and a deployed configuration; and opposed front and rear panels hingedly coupled to respective front and rear top flanges;

forming the key flap such that the rear top flange defines left and right key slots extending between a bottom surface of said rear top panel and respective top edges of left and right tabs when said key flap is in the deployed configuration; and folding said spacer assembly from the flat configuration to a three dimensional configuration, the folding step comprising:

positioning the front and rear panels relative to each other so that they are parallel with each other but displaced from each other;

folding the front top flange until it is generally perpendicular to the front panel such that the front top flange extends from a top edge of the front panel towards a top edge of the rear panel;

folding the rear top flange over the front top flange so as to form a top panel;

aligning the key flap with the key aperture;

folding the key flap through the key aperture until the key flap is perpendicular with the top panel, thereby moving the key flap to the deployed configuration.

11. The method of claim 10, further comprising forming the key aperture being configured to receive said key flap wherein said key flap is in the deployed configuration, such that the front top flange is engaged with respective left and right key slots, wherein said front top flange extends into left and right key slots.

12. The method of claim 11, further comprising positioning said front top flange into respective left and right key slots, thereby moving the spacer assembly to a locked configuration.

13. The method of claim 12, further comprising extending a vertical support member through a bottom panel of the spacer assembly towards the top panel of the spacer assembly and extending the key flap through a top opening of the vertical support member such that a distal end of the key flap is positioned in an interior area of the vertical support member, wherein a width of the key flap is equal to an inner diameter of the vertical support member.

14. The method of claim 13, further comprising forming an end profile of the bottom panel, the end profile being moveable between an open configuration and a closed configuration, wherein the open configuration of the end profile is configured to allow the sign to move in and out of lateral engagement with a vertical member, and wherein the closed configuration of the end profile is configured to restrict lateral movement of the sign relative to the vertical member.

15. The method of claim 14, further comprising forming a securing feature extending from the bottom panel, wherein the securing feature is moveable between a stowed configuration and deployed configuration, thereby moving the end profile of the bottom panel between the closed configuration and the open configuration, respectively, wherein the securing feature is parallel with the bottom panel when the securing feature is in the stowed configuration, and wherein the securing feature is angled away from the bottom panel when the securing feature in the deployed configuration.

16. The method of claim 15, further comprising forming an additional securing feature extending from a first end of the top panel, the first end of the top panel defining an end profile.

17. A method of securing a modular sign to a vertical support member, the method comprising:

moving the sign to a secured configuration; and inserting a key flap of the sign through a top opening of the vertical support member, wherein the angle of the key flap relative to a top panel of the modular sign remains constant as the key flap is inserted through the top opening of the vertical support member.

18. The method of claim 17, further comprising folding the key flap relative to the top panel until the key flap is perpendicular to the top panel, wherein a width of the key flap is equal to an inner diameter of the vertical support member.

* * * * *